US010745177B2

(12) United States Patent
Campbell

(10) Patent No.: US 10,745,177 B2
(45) **Date of Patent: *Aug. 18, 2020**

(54) PROTECTIVE BOTTLE ENCLOSURE

(71) Applicant: Camcal Enterprises, LLC, Phoenix, AZ (US)

(72) Inventor: Matthew T. Campbell, Cave Creek, AZ (US)

(73) Assignee: Camcal Enterprises, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/793,053

(22) Filed: Feb. 18, 2020

(65) Prior Publication Data

US 2020/0180816 A1 Jun. 11, 2020

Related U.S. Application Data

(63) Continuation of application No. 16/384,121, filed on Apr. 15, 2019, which is a continuation of application (Continued)

(51) Int. Cl.
*B65D 6/00* (2006.01)
*B65D 23/08* (2006.01)

(Continued)

(52) U.S. Cl.
CPC ..... *B65D 23/0885* (2013.01); *A47G 19/2205* (2013.01); *A47G 23/0241* (2013.01);

(Continued)

(58) Field of Classification Search
CPC ..... B65D 81/02; B65D 81/3876; B65D 81/3879; B65D 81/3888; B65D 23/0885;

(Continued)

(56) References Cited

U.S. PATENT DOCUMENTS 441,228 A 11/1890 Cherbonnier
460,918 A 10/1891 Kraetzer (Continued)

FOREIGN PATENT DOCUMENTS

DE 4126215 A1 2/1993
DE 102004025620 A1 2/2006

(Continued)

OTHER PUBLICATIONS

Back2Tap, [online], Reusable Bottles posted on Jan. 6, 2011, retrieved on Jan. 28, 2019. Retrieved from, <URL: http://www.back2tap.com/tag/stainless-steel-water-bottles/>, 3 pages.

(Continued)

*Primary Examiner* — Fenn C Mathew
*Assistant Examiner* — Elizabeth J Volz
(74) *Attorney, Agent, or Firm* — Quarles & Brady LLP

(57) ABSTRACT

A bottle enclosure that removably encloses a bottle includes a base having a sidewall that extends from a bottom wall. The base includes at least one thread, and the base bottom wall has a planar bottom surface. A body section of the bottle enclosure includes a cylindrical body wall that includes interior threading adjacent a bottom opening. The body section further includes a tapered shoulder section that is positioned between the body wall and a neck section. The neck section extends upward from the shoulder section and defines a cylindrical neck wall having a neck thread. The body section is configured to threadably and removably engage the base sidewall. The bottle enclosure further includes a removable cap with a sidewall that surrounds a cap cavity. The cap sidewall is configured to threadably and removably engage the neck.

28 Claims, 3 Drawing Sheets

Related U.S. Application Data

No. 16/154,550, filed on Oct. 8, 2018, now Pat. No. 10,464,712, which is a continuation of application No. 15/584,013, filed on May 1, 2017, now Pat. No. 10,118,735, which is a continuation of application No. 15/362,541, filed on Nov. 28, 2016, now Pat. No. 9,637,270, which is a continuation of application No. 14/153,688, filed on Jan. 13, 2014, now Pat. No. 9,505,527.

(60) Provisional application No. 61/752,404, filed on Jan. 14, 2013.

(51) Int. Cl.

| | |
|---|---|
| ***B65D 41/04*** | (2006.01) |
| ***B65D 81/02*** | (2006.01) |
| ***B65D 81/38*** | (2006.01) |
| ***A47G 23/02*** | (2006.01) |
| ***A47G 19/22*** | (2006.01) |
| ***B65D 1/02*** | (2006.01) |
| ***B65D 43/02*** | (2006.01) |
| *B65D 25/24* | (2006.01) |

(52) U.S. Cl.

CPC ..... *B65D 1/0246* (2013.01); *B65D 1/0261* (2013.01); *B65D 41/04* (2013.01); *B65D 41/0414* (2013.01); *B65D 43/0225* (2013.01); *B65D 81/02* (2013.01); *B65D 81/3876* (2013.01); *H05K 999/99* (2013.01); *A47G 23/02* (2013.01); *B65D 25/24* (2013.01); *B65D 81/3879* (2013.01); *B65D 81/3888* (2013.01)

(58) Field of Classification Search

CPC ..... B65D 1/0246; B65D 1/0261; B65D 1/06; B65D 43/0225; B65D 41/04; B65D 41/0414; A47G 19/2205; A47G 23/0241; A47G 23/02

USPC ..... 215/13.1, 356, 228, 12.1, 395, 386, 215/346.11, 311.2, 309.1, 346, 1; 220/4.12, 23.9, 592.16, 592.23, 592.24, 220/592.25, 739, 740, 737, 902, 903, 220/23.86; 206/446, 588, 217, 592; 229/89

See application file for complete search history.

(56) References Cited

U.S. PATENT DOCUMENTS

| | | | |
|---|---|---|---|
| 2,163,568 | A | 6/1939 | Schlumbohm |
| 2,889,065 | A | 6/1959 | Lawlor |
| 2,963,187 | A | 12/1960 | Bramming |
| 3,120,319 | A | 2/1964 | Buddrus |
| 3,229,840 | A | 1/1966 | Filleul |
| 3,308,980 | A | 3/1967 | Taylor |
| 3,335,891 | A | 8/1967 | Bailey |
| 4,444,324 | A | 4/1984 | Grenell |
| 4,510,769 | A | 4/1985 | McClellan, Jr. |
| D279,346 | S | 6/1985 | Ruxton |
| 4,690,300 | A | 9/1987 | Woods |
| 4,768,664 | A | 9/1988 | Zimmermann |
| 4,811,858 | A | 3/1989 | Augur |
| 4,823,974 | A | 4/1989 | Crosser |
| 5,186,350 | A | 2/1993 | McBride |
| 5,213,215 | A | 5/1993 | Prevot |
| 5,261,554 | A | 11/1993 | Forbes |
| 5,417,327 | A | 5/1995 | Saumure |
| 5,635,232 | A | 6/1997 | Wallace |
| 5,695,090 | A | 12/1997 | Burdick |
| 5,745,626 | A | 4/1998 | Duck |
| 5,904,267 | A | 5/1999 | Thompson |
| D410,548 | S | 6/1999 | Chomik |
| 5,975,337 | A | 11/1999 | Hadley |
| 5,992,677 | A | 11/1999 | Ebine |
| 6,427,863 | B1 | 8/2002 | Nichols |
| 6,467,644 | B1 | 10/2002 | Yeh |
| 6,604,649 | B1 | 8/2003 | Campi |
| D495,208 | S | 8/2004 | Putnam |
| 6,793,076 | B1 | 9/2004 | Luo et al. |
| D512,874 | S | 12/2005 | Poulson et al. |
| D543,791 | S | 6/2007 | Goto et al. |
| D547,610 | S | 7/2007 | Edelstein et al. |
| D553,914 | S | 10/2007 | Wahl |
| D573,390 | S | 7/2008 | Ablo |
| D586,186 | S | 2/2009 | Bhavnani |
| D604,561 | S | 11/2009 | Chisholm |
| D614,918 | S | 5/2010 | Chisholm |
| D615,823 | S | 5/2010 | Gilbert |
| D616,743 | S | 6/2010 | Cresswell et al. |
| D619,418 | S | 7/2010 | Nezu et al. |
| D621,220 | S | 8/2010 | Lown et al. |
| D624,362 | S | 9/2010 | Wahl |
| D626,416 | S | 11/2010 | Cresswell et al. |
| D627,227 | S | 11/2010 | Andis |
| D627,601 | S | 11/2010 | Eyal |
| D628,486 | S | 12/2010 | Lane |
| D632,522 | S | 2/2011 | Wahl et al. |
| D632,524 | S | 2/2011 | Rosbach et al. |
| D633,338 | S | 3/2011 | Rosbach et al. |
| D635,457 | S | 4/2011 | Lane |
| D640,494 | S | 6/2011 | Frederiksen |
| D648,984 | S | 11/2011 | Gullickson et al. |
| D651,853 | S | 1/2012 | Eyal |
| D652,255 | S | 1/2012 | Carland |
| D652,682 | S | 1/2012 | Eyal |
| D653,081 | S | 1/2012 | George |
| D655,581 | S | 3/2012 | Kotani |
| D656,025 | S | 3/2012 | Carreno |
| D657,196 | S | 4/2012 | Beyers, III |
| D658,450 | S | 5/2012 | Ying |
| D658,944 | S | 5/2012 | Gilbert et al. |
| D660,081 | S | 5/2012 | Gilbert |
| D661,945 | S | 6/2012 | Eyal |
| D662,767 | S | 7/2012 | Hotell et al. |
| D664,809 | S | 8/2012 | Eyal |
| D670,525 | S | 11/2012 | Fallon et al. |
| D672,609 | S | 12/2012 | Aziz et al. |
| D675,882 | S | 2/2013 | Crockett |
| D676,708 | S | 2/2013 | Lane |
| D687,677 | S | 8/2013 | Sturgess |
| D689,332 | S | 9/2013 | Krasner |
| D691,420 | S | 10/2013 | McIntire |
| D691,849 | S | 10/2013 | Cetera et al. |
| D693,170 | S | 11/2013 | Rosbach |
| D695,069 | S | 12/2013 | Lane |
| D695,138 | S | 12/2013 | Ball |
| D696,118 | S | 12/2013 | Lindstrom |
| D696,900 | S | 1/2014 | George et al. |
| D696,945 | S | 1/2014 | Newman |
| D699,516 | S | 2/2014 | Kim et al. |
| D700,802 | S | 3/2014 | Miller |
| D700,808 | S | 3/2014 | Eyal |
| D702,086 | S | 4/2014 | Thurlow |
| D702,092 | S | 4/2014 | Mettler et al. |
| D702,506 | S | 4/2014 | Mettler et al. |
| D705,063 | S | 5/2014 | Weiss |
| D706,032 | S | 6/2014 | Roth et al. |
| D710,155 | S | 8/2014 | Tatsukawa |
| D716,653 | S | 11/2014 | Balembois |
| D724,385 | S | 3/2015 | Hurley et al. |
| D725,968 | S | 4/2015 | George |
| D726,476 | S | 4/2015 | Ercanbrack |
| D727,171 | S | 4/2015 | Marina et al. |
| D727,671 | S | 4/2015 | Gamelli |
| D729,019 | S | 5/2015 | Kilduff et al. |
| D736,563 | S | 8/2015 | George |
| D737,144 | S | 8/2015 | Hughes et al. |
| D738,692 | S | 9/2015 | Kilduff et al. |
| D740,609 | S | 10/2015 | Ayres |
| D741,655 | S | 10/2015 | Whelan et al. |
| D743,741 | S | 11/2015 | Itzhaki |

(56) References Cited

U.S. PATENT DOCUMENTS

| | | | |
|---|---|---|---|
| D758,132 | S | 6/2016 | Breit |
| D758,800 | S | 6/2016 | Hayslett et al. |
| D761,624 | S | 7/2016 | McLean et al. |
| D771,357 | S | 11/2016 | Brewer |
| D772,014 | S | 11/2016 | Ayres |
| 9,505,527 | B1 | 11/2016 | Campbell |
| D774,837 | S | 12/2016 | Seiders et al. |
| D779,273 | S | 2/2017 | Lee et al. |
| D779,323 | S | 2/2017 | Masrour |
| D779,881 | S | 2/2017 | Lee et al. |
| D780,530 | S | 3/2017 | Seiders et al. |
| D780,531 | S | 3/2017 | Seiders et al. |
| D780,532 | S | 3/2017 | Seiders et al. |
| D780,533 | S | 3/2017 | Seiders et al. |
| D781,662 | S | 3/2017 | Seiders et al. |
| D782,881 | S | 4/2017 | Seiders et al. |
| D783,367 | S | 4/2017 | Seiders et al. |
| D783,368 | S | 4/2017 | Seiders et al. |
| D784,775 | S | 4/2017 | Seiders et al. |
| D785,412 | S | 5/2017 | Petre |
| D786,012 | S | 5/2017 | Hein et al. |
| D786,617 | S | 5/2017 | Breit |
| D787,886 | S | 5/2017 | Cerasani |
| D787,893 | S | 5/2017 | Seiders et al. |
| D787,894 | S | 5/2017 | Seiders et al. |
| 9,637,270 | B2 | 5/2017 | Campbell |
| D788,544 | S | 6/2017 | Seiders et al. |
| D789,796 | S | 6/2017 | McSweeney et al. |
| D790,285 | S | 6/2017 | Seiders et al. |
| D791,550 | S | 7/2017 | Marret |
| D794,397 | S | 8/2017 | Seiders et al. |
| D795,019 | S | 8/2017 | Seiders et al. |
| D795,020 | S | 8/2017 | Seiders et al. |
| D796,261 | S | 9/2017 | Khalifa et al. |
| D799,898 | S | 10/2017 | Yao |
| D799,900 | S | 10/2017 | Santos et al. |
| D799,906 | S | 10/2017 | Seiders et al. |
| D799,907 | S | 10/2017 | Seiders et al. |
| D799,908 | S | 10/2017 | Seiders et al. |
| D800,502 | S | 10/2017 | Weernink |
| D803,064 | S | 11/2017 | Marina et al. |
| D803,632 | S | 11/2017 | Seiders et al. |
| D804,906 | S | 12/2017 | Diener et al. |
| D805,852 | S | 12/2017 | Seiders et al. |
| D806,477 | S | 1/2018 | Wray et al. |
| D807,125 | S | 1/2018 | Seiders et al. |
| D808,220 | S | 1/2018 | Burns et al. |
| D809,344 | S | 2/2018 | Guthrie |
| D809,920 | S | 2/2018 | Maple |
| D811,817 | S | 3/2018 | Harrington, III et al. |
| D811,818 | S | 3/2018 | Wu |
| D813,613 | S | 3/2018 | Wall |
| D814,241 | S | 4/2018 | Nickley et al. |
| D814,865 | S | 4/2018 | Breit |
| D816,411 | S | 5/2018 | Stover |
| D817,713 | S | 5/2018 | Lin |
| D817,714 | S | 5/2018 | Breit |
| D818,775 | S | 5/2018 | Woodruff |
| D819,403 | S | 6/2018 | Li et al. |
| D820,650 | S | 6/2018 | Seiders et al. |
| D821,138 | S | 6/2018 | Silsby et al. |
| D823,068 | S | 7/2018 | Seiders et al. |
| D823,069 | S | 7/2018 | Seiders et al. |
| D824,218 | S | 7/2018 | Seiders et al. |
| D828,094 | S | 9/2018 | Jackson et al. |
| D828,095 | S | 9/2018 | Jackson et al. |
| D829,056 | S | 9/2018 | Wall |
| D829,058 | S | 9/2018 | Seiders et al. |
| D829,101 | S | 9/2018 | Spivey et al. |
| D830,773 | S | 10/2018 | Jacobsen |
| D830,774 | S | 10/2018 | Jacobsen |
| D830,784 | S | 10/2018 | Moore et al. |
| D831,436 | S | 10/2018 | Seiders et al. |
| D834,373 | S | 11/2018 | Spivey et al. |
| 10,118,735 | B2 * | 11/2018 | Campbell ..... B65D 41/0414 |
| D837,597 | S | 1/2019 | Silsby |
| 10,384,832 | B2 | 8/2019 | Johnson |
| 2004/0045972 | A1 | 3/2004 | Stokes |
| 2004/0124192 | A1 | 7/2004 | Teller |
| 2005/0224442 | A1 | 10/2005 | White |
| 2005/0269322 | A1 | 12/2005 | Betras et al. |
| 2007/0051687 | A1 | 3/2007 | Olson |
| 2007/0119517 | A1 | 5/2007 | Grace |
| 2007/0125785 | A1 | 6/2007 | Robinson et al. |
| 2007/0175906 | A1 | 8/2007 | Caladrino |
| 2007/0221693 | A1 | 9/2007 | Moore |
| 2009/0056369 | A1 | 3/2009 | Fink et al. |
| 2009/0266737 | A1 | 10/2009 | Cole |
| 2010/0005828 | A1 | 1/2010 | Fedell |
| 2010/0084362 | A1 * | 4/2010 | Letchinger ..... B65D 11/04 215/200 |
| 2010/0288723 | A1 | 11/2010 | Mayer |
| 2011/0011823 | A1 | 1/2011 | Moore |
| 2011/0114588 | A1 | 5/2011 | Nowzari |
| 2011/0204048 | A1 * | 8/2011 | Carino ..... B65D 21/083 220/4.03 |
| 2012/0145591 | A1 | 6/2012 | Ceder |
| 2012/0199548 | A1 | 8/2012 | Kitto |
| 2013/0153591 | A1 | 6/2013 | Grimes et al. |
| 2013/0206717 | A1 | 8/2013 | Lane |
| 2014/0238949 | A1 | 8/2014 | Patel |
| 2015/0021346 | A1 | 1/2015 | Cappuccio |
| 2018/0194518 | A1 | 7/2018 | Li et al. |
| 2018/0194537 | A1 | 7/2018 | Chan |

FOREIGN PATENT DOCUMENTS

| | | | |
|---|---|---|---|
| EP | 1452455 | A1 | 9/2004 |
| FR | 1054716 | A | 2/1954 |
| JP | 2008030773 | A | 2/2008 |
| KR | 20100000510 | U | 1/2010 |
| TW | M460607 | U | 9/2013 |
| WO | 200863750 | A2 | 5/2008 |

OTHER PUBLICATIONS

Benefits of Stainless Steel Water Bottles, [online] posted on Mar. 1, 2012, retrieved on Jan. 28, 2019. Retrieved from <URL: https://b2bbusinessnews.wordpress.com/2012/03/01/benefits-of-stainless-steel-water-bottles/>, 3 pages.

Brewtis the BottleKeeper. [online], posted on Dec. 28, 2013, retrieved on Jan. 28,2019. Retrieved from, <URL: http://ww.dudeiwantthat.com/gear/food-drink/brewtis-the-bottlekeeper.asp>, 22 pages.

EarthLust Stainless Steel Water Bottle, [online], product reviewed on Oct. 17, 2008, retrieved on Jan. 28, 2019, Retrieved from, <URL: https://www.amazon.com/dp/B001DYOCOW?tag=new-best-seller-20>, 4 pages.

Neiko 71010 Stainless Steel Sports Water Bottle, [online], published on Nov. 3, 2009, retrieved on Jan. 28, 2019, Retrieved from, <URL: https://www.amazon.com/Eco-Friendly-Mouth-Stainless-Steel-Bottle/dp/B002VDA2AC/ref=sr_1_107?s=sporting-goods&ie=UTFB&qid=1396116064&s%E2%80%A6>, 8 pages.

Wawabots Personalized Photo Water Bottles, [online], published on Nov. 30, 2011, retrieved on Jan. 28, 2019. Retrieved from, <URL: https//inhabitat.com/inhabitatots/product-review-wawabots-personalized-photo-water-bottles/>, 7 pages.

* cited by examiner

PROTECTIVE BOTTLE ENCLOSURE

CROSS-REFERENCE TO RELATED APPLICATIONS

This application is a continuation of U.S. application Ser. No. 16/384,121, filed on Apr. 15, 2019, which is a continuation of U.S. application Ser. No. 16/154,550, filed on Oct. 8, 2018, entitled "Protective Bottle Enclosure," and issued as U.S. Pat. No. 10,464,712 on Nov. 5, 2019, which is a continuation of U.S. application Ser. No. 15/584,013, filed on May 1, 2017, entitled "Protective Bottle Enclosure," and issued as U.S. Pat. No. 10,118,735 on Nov. 6, 2018, which is a continuation of U.S. application Ser. No. 15/362,540, filed on Nov. 28, 2016, entitled "Protective Bottle Enclosure," and issued as U.S. Pat. No. 9,637,270 on May 2, 2017, which is a continuation of U.S. application Ser. No. 14/153,688, filed on Jan. 13, 2014, entitled "Protective Bottle Enclosure," and issued as U.S. Pat. No. 9,505,527 on Nov. 29, 2016, which claims priority to U.S. Provisional Application Ser. No. 61/752,404, filed on Jan. 14, 2013, and entitled "Protective Bottle Enclosure," all of which are hereby incorporated herein by reference in their entirety and are to be considered a part of this specification.

BACKGROUND

1. Field of the Disclosure

The present disclosure relates generally to food and beverages, and more particularly to containers for holding beverages and beverage bottles.

2. Description of the Background of the Disclosure

Many people like to drink beverages while on the go. Beverages are often carried by people for different reasons and to different places, such as to the beach, to the office, in the car, on a boat, at the golf course, at the shopping mall, and other similar places. Once opened, however, a bottle can spill contents, wasting the beverage and creating a mess. Further, for some beverages, once the bottle is opened, the beverage contained therein will lose its freshness or effervescence as gases in the beverage leave the beverage and escape the bottle. Some bottles have caps or lids designed to be re-applied to an open bottle top so as to close the bottle and prevent spills. However, many bottles, such as glass bottles, do not have caps or lids that can be re-applied. Instead, the beverages in these bottles must generally consumed in one sitting, or the drinker must drink some of the beverage immediately after opening and then the rest at a later time, sacrificing the freshness or effervescence when finishing the beverage. Further, most beverages, if consumed over a period of time, will gradually equalize with the ambient temperature of the environment, which can be undesirable if the beverage was meant to be consumed very hot or very cold. An improved device for carrying a beverage is needed.

SUMMARY

According to one aspect, a bottle enclosure that removably encloses a bottle includes a base having a cylindrical base sidewall that extends from a base bottom wall and an open top. The base includes at least one thread disposed on the base sidewall and adjacent the open top. The base bottom wall has a planar bottom surface. A body section includes a cylindrical body wall that includes interior threading adjacent a bottom opening. A tapered shoulder section is positioned between the body wall and a neck section. The neck section extends upward from the shoulder section and defines a cylindrical neck wall comprising a neck thread and defines a neck opening. An internal cavity is located between the neck opening and the bottom opening. The shoulder section is disposed between the neck section and the body section. The body section is configured to threadably and removably engage the base sidewall of the base. A removable cap includes a cap sidewall that surrounds a cap cavity. The cap cavity extends between a top wall and a cap opening. The cap sidewall is configured to threadably and removably engage the neck section and includes a knob and an extension. The knob includes a contact surface configured to be gripped or rotated.

According to another aspect, a bottle enclosure that removably encloses a bottle includes a bottom section having a bottom wall from which a base sidewall extends. The base sidewall defines a base opening that is disposed opposite the bottom wall. A body section defines a body sidewall and a body opening. The body section is configured to threadably and removably engage the base sidewall. A shoulder section is disposed adjacent the body section and defines a tapered shoulder sidewall. A neck section includes a neck sidewall that defines a neck opening. The neck section is disposed adjacent the shoulder section. An internal cavity is disposed between the body opening and the neck opening. A cap includes a top wall that is integral with a cap sidewall. The cap sidewall defines a cap opening that is disposed opposite the top wall. The cap is configured to threadably and removably engage the neck section. The base sidewall, the body sidewall, and the cap sidewall are all cylindrical. The base, the body section, the shoulder section, the neck section, and the cap are configured to surround and enclose a bottle. The body sidewall includes plastic.

According to still another aspect, a bottle enclosure that removably encloses a bottle includes a base section including a bottom wall from which a base sidewall extends. The base sidewall defines a base opening disposed opposite the bottom wall. A body section includes a body sidewall and a body opening. The body section is configured to threadably and removably engage the base sidewall. A shoulder section is disposed adjacent the body section and includes a tapered shoulder sidewall. A neck section includes a neck sidewall and a neck opening. The neck section is integral with the shoulder section. The shoulder section is disposed above the body section. A cap includes a top wall that is integral with a cap sidewall. The cap sidewall defines a cap opening disposed opposite the top wall. The cap is configured to threadably and removably engage with the neck section. The base sidewall and the body sidewall are cylindrical. The base, the body section, the shoulder section, the neck section, and the cap are configured to surround and enclose an entire bottle.

DETAILED DESCRIPTION

Figure 1:
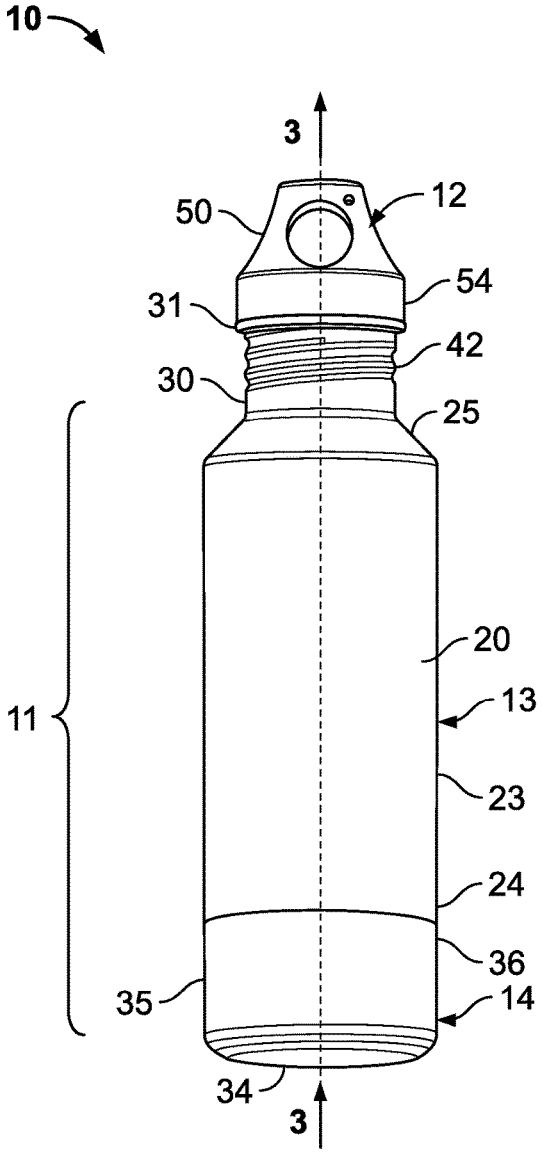
FIG. 1 is a front perspective view of a protective bottle enclosure constructed and arranged in accordance with the principle of the disclosure, including a container having an upper portion, a base applied to the upper portion, and a cap applied to the upper portion.
Figure 2:
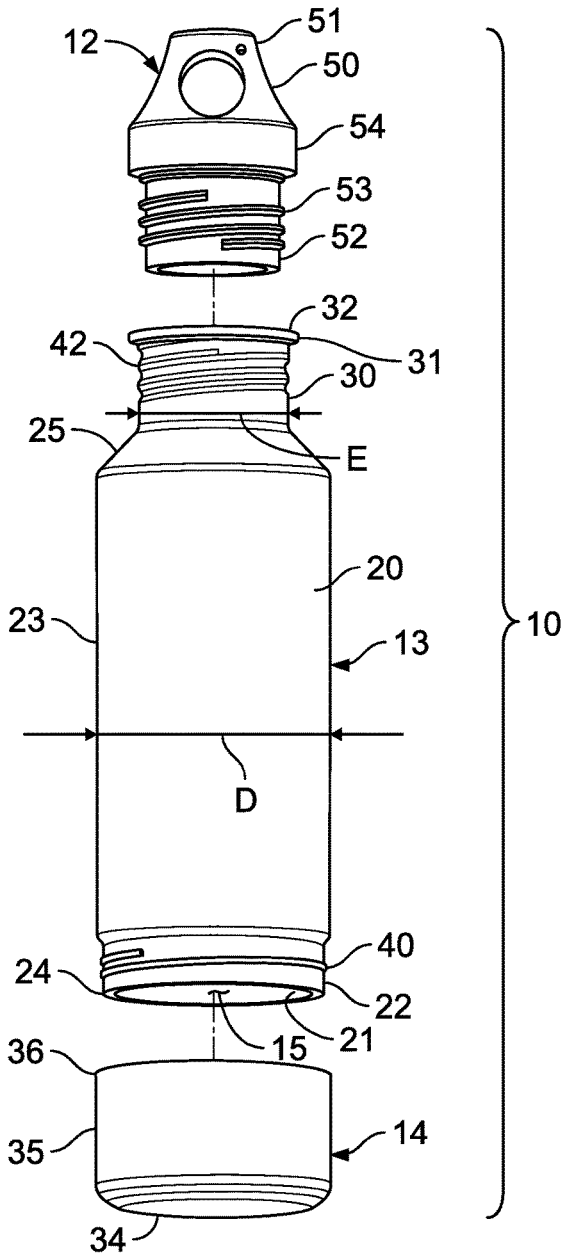
FIG. 2 is an exploded front perspective view of the protective bottle enclosure of FIG. 1.

Reference is now made to the drawings. FIG. 1 illustrates a protective bottle enclosure 10 constructed and arranged according to the principle of the disclosure. FIG. 2 illustrates the same enclosure 10 in an exploded view. The enclosure 10 is useful for containing, concealing, and insulating a bottle applied to the enclosure in such a way that a beverage from the bottle can be consumed while the bottle is protected within the enclosure 10. The enclosure 10 includes a container 11 and a cap 12 removably applied to the container 11. The container 11 is preferably constructed from a material or materials having material characteristics of strength and rigidity, such as metal or plastic. The container 11 is preferably a two-piece unit having a main upper portion 13 and a base 14 removably applied to the upper portion 13. The upper portion 13 and base 14 cooperate to define a generally cylindrical interior 15 (indicated in FIG. 2) which receives the beverage bottle that the enclosure 10 protects. The upper portion 13 and base 14 are preferably extruded or rolled from thin-walled aluminum or the like.

The upper portion 13 is formed from a continuous thin sidewall 20 having opposed inner and outer surfaces 21 and 22 which are parallel to each other and set just slightly apart, defining a very thin thickness of the sidewall 20. The upper portion 13 of the container 11 defines a majority of the container 11 and has a body 23 extending from a bottom 24 to a shoulder 25 of the container 11. The shoulder 25 is an annular narrowing of the container 11 which tapers from the body 23 to a neck 30 of the container 11. The neck 30 extends upward to a finish 31 which terminates in an annular lip 32. The body 23 of the upper portion has a constant diameter D from just above the bottom 24 to the just below the shoulder 25. The neck has a diameter E which is less than the diameter D of the body 23, since the shoulder 25 between the body 23 and the neck 30 tapers in diameter between the two. The lip 32 flares outward slightly from the diameter E of the neck 30.

The base 14 is removable from the upper portion 13 so that a bottle may be introduced into the interior 15 and carried therein. Still referring to FIGS. 1 and 2, the base 14 has a flat bottom 34 and an upstanding, annular sidewall 35 extending upward from the bottom 34 and terminating in an open top 36. To releasably couple the base 14 to the upper portion 13, a fastening assembly is carried between the upper portion 13 and the base 14. At the bottom 24 of the body 23, the upper portion 13 of the container 11 has a reduced diameter and is formed with external threads 40. Complemental internal threads are carried on the sidewall 35 of the base 14. Though not visible in FIGS. 1 and 2, the internal threads are visible in FIG. 3 and are identified there with the reference number 41. The two sets of threads 40 and 41 threadably engage the base 14 to the upper portion 13 of the container 11 and allow the base 14 to be quickly and easily removed from the upper portion 13. By aligning the threads 40 and 41 and rotating the base 14 with respect to the upper portion 13 in a clockwise direction, the base 14 is secured to the upper portion 13. Conversely, by rotating the base 14 in a counter-clockwise direction with respect to the upper portion 13 and retracting the base 14 away from the upper portion 13, the base 14 is removed from the upper portion 13, and the bottom 24 of the upper portion 13 is open, defining an entrance available to apply a bottle there through into the interior 15 of the container 11. One having ordinary skill in the art will readily appreciate that the relative direction of the threads 40 and 41 may be reversed so that the direction of rotation of the base 14 with respect to the upper portion 13 would be correspondingly reversed to apply and remove the base 14 from the upper portion 13. One having ordinary skill in the art will also appreciate that another suitable fastening mechanism may be used to removably engage the base 14 to the upper portion 13.

Figure 3:
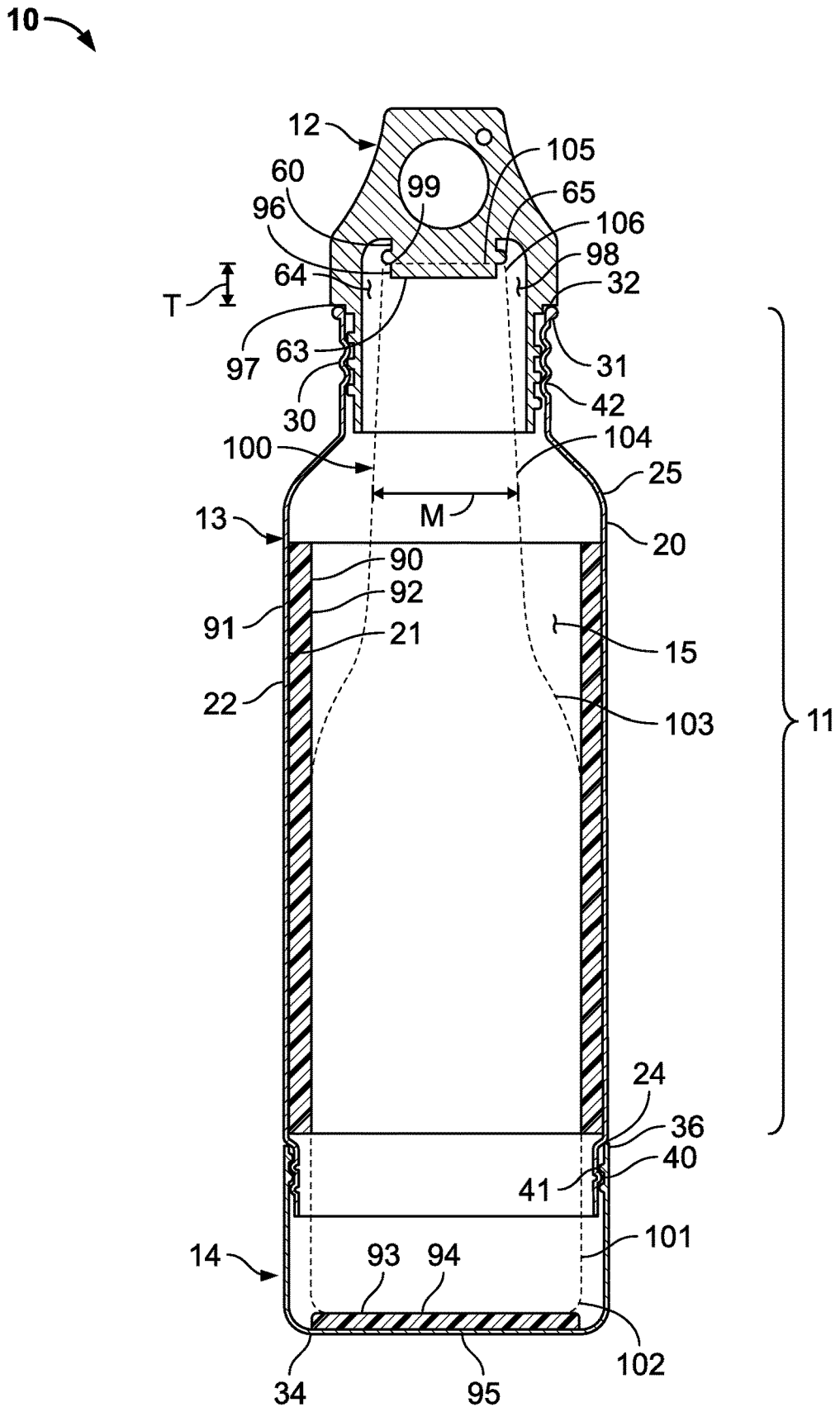
FIG. 3 is a section view of the protective bottle enclosure of FIG. 1 taken along the line 3-3 in FIG. 1.

Turning briefly to FIG. 3, a bottle 100 has been applied to the interior 15 of the container 11. The bottle 100 is shown in ghost form, or in broken line, in FIG. 3, which is a section view taken along the line 3-3 in FIG. 1. The container 11 has rotational symmetry about a vertical axis extending through the interior 15 along a geometric center of the container 11. The bottle 100 is applied to the enclosure 10, and has a body 101, a bottom 102, a shoulder 103, and a long neck 104 terminating in an open mouth 105 at a top 106 of the bottle 100. The mouth 105 of the bottle 100 has an internal diameter M. The bottle 100 has been, and is preferably, inserted into the enclosure 10 with the mouth 105 open so that the cap 12 seals the open mouth 105 when the cap 12 is fully applied and seated to the container 11.

Figure 4A:
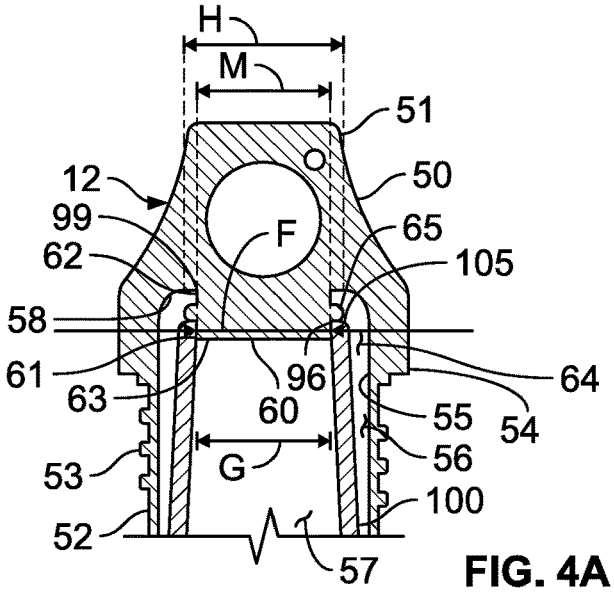
FIGS. 4A-4C are section views of three embodiments of caps taken along similar lines as FIG. 3.
Figure 4B:
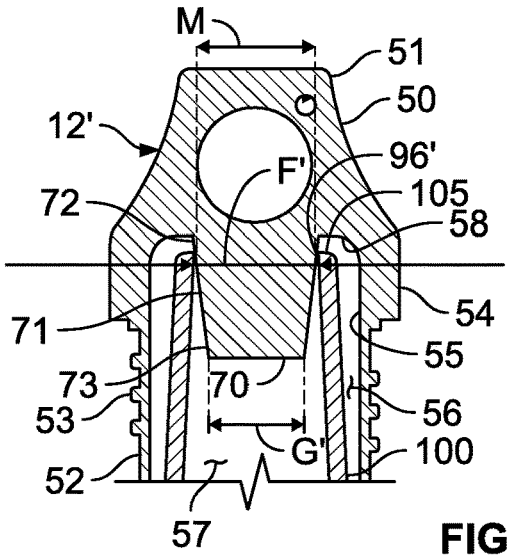
Figure 4C:
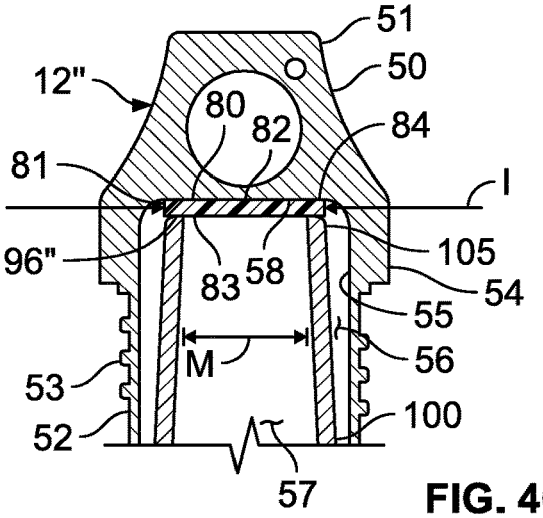

Referring now back to FIG. 2 primarily, the cap 12 is removably applied to the container 11 to seal the container 11. The neck 30 of the upper portion 13 of the container 11 carries threads 42 which are formed integrally in the neck 30 and extend both inwardly and outwardly. The threads 42 allow the cap 12 to be threadably engaged to the container 11 to secure and release the cap 12 on the container. Three cap embodiments are shown in FIGS. 4A-4C and are identified as the caps 12, 12', and 12", respectively. Discussion of the cap 12 in FIG. 4A will be made first, and then, turning to FIGS. 4B and 4C, the discussion will be of the caps 12' and 12" and the various structural elements and features which are different from the cap 12. Discussion of structural elements and features which are identical in the caps 12, 12', and 12" will not be repeated in the description of the caps 12' and 12".

FIG. 4A illustrates an enlarged section view of the cap 12 taken along the line 3-3 in FIG. 1. The cap 12 consists of a knob 50 formed with a tab or extension 51 providing a contact surface to be gripped and rotated, and a collar 52 depending from the knob 50 opposite the extension 51. The collar 52 is a thin cylindrical sleeve which extends downward from the knob 50 and carries external threads 53. The threads 53 extend radially outward from the collar 52. The threads 53 of the cap 12 threadably engage with the internal threads 42 formed in the neck 30 of the upper portion 13, so that the cap 12 is applied and engaged to the upper portion 13 by aligning the threads 53 and 42 and rotating the cap 12 clockwise relative to the upper portion 13, and the cap 12 is retracted and disengaged from the upper portion 13 by rotating the cap 12 counterclockwise relative to the upper portion 13. One having ordinary skill in the art will understand that the relative direction of the threads 42 and 53 may be reversed and that the direction of rotation of the cap 12 relative to the upper portion 13 would be correspondingly reversed to apply and remove the cap 12. The cap has a cuff 54 disposed between the extension 51 and the collar 52 extending radially outward from an underside 58 of the extension 51 and defining a lower portion of the extension 51. The cuff 54 is a cylindrical sidewall having an inner surface 55 cooperating with the collar 52 to bound an internal, generally cylindrical volume 56 with an opening 57 located opposite the extension 51.

Still referring to FIG. 4A, the cap 12A has a sealing structure to seal the mouth 105 of the bottle 100 while housed in the container 11. The cap 12 has a stopper 60 with a body 61 which is an inverted truncated conical frustum that tapers in diameter away from the cap 12. The body 61 has a top 62 and an opposed bottom 63 with a diameter G, and the diameter G at the bottom 63 is smaller than the diameter at the top 62 of the body 61. The top 62 of the body 61 is applied to the underside 58 of the knob 50. The body 61 is constructed from a material or combination of materials having material characteristics of resiliency, elasticity, and shape memory, such as rubber, so that the body 61 of the stopper 60 can be compressed radially under pressure and return to its original shape when the compression is removed. The body 61 of the stopper 60 extends within the cylindrical volume 56 as far as the cuff 54, and an annular volume 64 in communication with the cylindrical volume 56 is defined between the body 61 of the stopper 60 and the inner surface 55 of the cuff 54 which encircles the stopper 60 within the cap 12. An annular flange 65 is formed on the body 61 of the stopper 60. The flange 65 is a ring formed monolithically and integrally to the body 61, and the flange extends continuously around the body 61 parallel to the top 62 and bottom of the stopper 60. The body 61 has a diameter F just under the flange 65, and the flange 65 has a diameter H, which is larger than the diameter F and the diameter G of the bottom 63 of the body 61 of the stopper 60. The diameter H of the flange 65 is greater than the diameter M of the mouth 105 of the bottle 100, and the diameter M of the mouth 105 is larger than the diameter G of the bottom 63 of the stopper 60 but just smaller than the diameter F of the stopper 60. The flange 65 is constructed from a material having a rigid material characteristics, such as plastic. The flange 65 is formed on the body 61 at a generally intermediate location with respect to the top 62 and bottom 63.

Turning now to FIG. 4B, the cap 12' is shown. As explained above, the cap 12' shares various structural elements and features in common with the cap 12, and as such, those structural elements and features will not be described here. Those structural elements and features are identified in the discussion of the cap 12' with the same reference characters as above, and the discussion below is directed toward the differences of cap 12'. The cap 12' has a knob 50, extension 51, collar 52, threads 53, cuff 54, inner surface 55, cylindrical volume 56, opening 57, and underside 58, but the cap 12' presents an alternate stopper 70.

The stopper 70 has a body 71 which is an inverted truncated conical frustum that tapers in diameter away from the cap 12'. The body 71 has a top 72 and an opposed bottom 73 with respective diameters F' and G', and the diameter G' at the bottom 73 is smaller than the diameter F' at the top 72 of the body 71. The top 72 of the body 71 is applied to the underside 58 of the knob 50. The body 71 is constructed from a material or combination of materials having material characteristics of resiliency, elasticity, and shape memory, such as rubber, so that the body 71 of the stopper 70 can constrict and be compressed radially under pressure and return to its original shape when the compression is removed. The body 71 of the stopper 70 extends within the cylindrical volume 56 as far as the cuff 54, and the annular volume 64 in communication with the cylindrical volume 56 is defined between the body 71 of the stopper 70 and the inner surface 55 of the cuff 54 which encircles the stopper 70 within the cap 12. The diameter M of the mouth 105 of the bottle 100 is larger than the diameter G' of the bottom 73 of the stopper 70 but is smaller than the diameter F' of the top 62 of the bottle 100. In this way, when the cap 12' is applied to and seated on the container 11, the mouth 105 encircles and constricts the stopper 60 between the top 62 and bottom 63.

Turning now to FIG. 4C, the cap 12" is shown. Again, as explained above, the cap 12" shares various structural elements and features in common with the cap 12, and as such, those structural elements and features will not be described here. Those structural elements and features are identified in the discussion of the cap 12" with the same reference characters as above, and the discussion below is directed toward the differences of cap 12". The cap 12" has a knob 50, extension 51, collar 52, threads 53, cuff 54, inner surface 55, cylindrical volume 56, opening 57, and underside 58, but the cap 12' presents an alternate stopper 80.

The stopper 80 of the cap 12" is a pad 81 carried on the underside 58 of the knob 50. The pad 81 includes an upper surface 82, an opposed lower surface 83, and a compressible middle layer 84 between the upper and lower surfaces 82 and 83. The upper surface 82 is permanently applied, such as with an adhesive, to the underside 58 of the knob 50 and extends across the underside 58 encircled by the inner surface 55 of the cuff 54. The pad 81 has a diameter I, which is greater than the diameter M of the mouth 105 of the bottle 100. The pad 81 is constructed from a material or combination of materials having compressible, elastic, resilient, and durable material characteristics, such as elastomeric rubber and the like.

The caps 12, 12', and 12" each seal the open bottle 100 and the container 11 when used as part of the enclosure 10. The bottle 100 is held within the enclosure 10 by the cap and by elastomeric padding or forms within the container 11. The elastomeric forms are applied to the upper portion 13 and the base 14 to provide insulation to the bottle 100, to provide impact protection to the bottle 100, and to hold the bottle 100 securely, both while the bottle 100 is enclosed by the enclosure 10 and while the bottle is tipped and being drunk from. With reference back to FIG. 3, the upper portion 13 has an upper form 90 with an outer surface 91 applied, such as with an adhesive, to the inner surface 21 of the container 11 and an inner surface 92 extending into the interior 15 of the enclosure 10. The upper form 90 has a generally cylindrical shape extending from the bottom 24 of the upper portion 13 to the shoulder 25. The upper form 90 is constructed from a material or combination of materials having material characteristics of compressibility, durability, resiliency, and shape memory, and which is a good insulator. The base 14 has a base pad 93 with an upper surface 94 and an opposed lower surface 95 applied, such as with an adhesive, to the bottom 34 of the base 14. The base form 93 is disc shaped and extends along the bottom 34 of the base 14. The sidewall of the base 14 is uncovered in the interior 15. Like the upper form 90, the base form 93 is constructed from a material or combination of materials having the material characteristics of compressibility, durability, resiliency, and shape memory, and which is a good insulator. The upper and base forms 90 and 93 securely position and hold the bottle 100 in place within the container and provide insulation to keep the beverage in the bottle 100 hot or cold.

In operation, the enclosure 10 is useful for protecting, insulating, and concealing the bottle 100 within the enclosure 10. To apply the bottle 100 to the enclosure 10, the base 14 is decoupled from the upper portion 13 by rotating the base 14 relative to the upper portion 13 while retracting the base 14 and then withdrawing the base 14 from the upper portion 13, exposing the open bottom 24 of the upper portion 13 and the upper form 90 ready to receive the bottle 100. The bottle 100 is held, such as by hand, and inserted into the interior 15 with the mouth 105 of the bottle 100 introduced first into the interior 15. The bottle 100 is applied to and inserted into the interior 15 until the mouth 105 of the bottle 100 is disposed just below the lip 32 on the finish 31 of the upper portion 13. As the bottle 100 is applied into the interior 15, the bottle 100 radially compresses the upper form 90 against the sidewall 20 of the upper portion 13. As shown in FIG. 3, above the shoulder 103 of the bottle 100, the upper form 90 is uncompressed and has a normal thickness, while along the body 101 of the bottle 100, the upper form 90 is compressed and has a reduced thickness. The bottle 100 is thus held in a friction fit arrangement by the upper form 90 which limits vertical movement in and out of the upper portion 13.

Once the bottle 100 is placed into the upper portion 13, the base 14 is coupled to the upper portion 13. The base 14 is aligned with the upper portion 13 and moved toward and over the bottom 24 of the upper portion 13 while rotating the base 14 with respect to the upper portion 13 so as to threadably engage the base 14 onto the upper portion 13. The base 14 is rotated completely until the base 14 is firmly seated on the upper portion 13 and the open top 36 of the base 14 is against the bottom 24 of the upper portion 13, sealing the base 14 on the upper portion 13 and forming the container 11. If, before coupling the base 14 to the upper portion 13, the bottle 100 had not been fully applied to the upper portion 13, then when the base 14 is seated to the upper portion 13, the base 14 will advance the bottle 100 further into the upper portion 13 to a preferred location in the interior 15. If the bottle 100 had been applied too far into the interior 15, then application of the cap 12 to the upper portion 13 will re-position the bottle 100 in the opposite direction. Any of the caps 12, 12', and 12" may be applied and seated on the upper portion 13. Seating any of the caps 12, 12', and 12" on the container 12 forms seals between the bottle 100 and the cap 12 and between the container 11 and the cap 12. Application of each will now be discussed.

FIG. 3 and FIG. 4A show the cap 12 fully seated on the upper portion 13 in a seated position of the cap 12, sealing the open mouth 105 of the bottle 100, To apply the cap 12 to the container 11 with the bottle 100 held in the container 11, the cap 12 is free of the container 11 and is aligned with the neck 30 and finish 31 of the container 11 in a free condition of the cap 12. The threads 53 on the cap 12 are directed downwardly toward the threads 42 on the neck 30 of the container 11. The cap 12 is then rotated onto the neck 30, threadably engaging the threads 53 on the cap 12 with the threads 42 formed in the neck 30 of the container 11 to move the cap 12 into an applied condition on the container 11. As the cap 12 is threaded onto the container 11, the cap 12 is applied to the container 11, and the bottom 63 of the stopper 60 moves into the mouth 105 of the bottle 100. The bottom 63 of the stopper 60 has a diameter G which is less than the diameter M of the mouth 105, so that the mouth 105 begins to receive the stopper 60. As the cap 12 is further threaded onto the container 11, the stopper 60 advances further into bottle 100, filling a greater portion of the diameter M of the mouth 105. In this applied condition of the cap 12, the cap 12 only yet forms a fluid-permeable seal with the container 11. As the cap 12 is still further threaded onto the container 11, however, the stopper 60 fills the entire open mouth 105 of the bottle 100, and begins to be compressed and constricted radially by the mouth 105. The cap 12 continues to be advanced until the top 106 of the bottle 100 encounters the flange 65 on the stopper 60, at which point the cuff 54 of the cap 12 fully seats against the lip 32 of the upper portion 13 of the container 11. The diameter F of the body 61 of the stopper 60 just below the flange 65 is just greater than the diameter M of the mouth 105, and the diameter H of the flange 65 is greater than the diameter M of the mouth 105, so that the mouth 105 is received against an inward shoulder 99 formed by the body 61 of the stopper 60 and the flange 65, defining a seated condition of the cap 12. In this seated condition, the stopper 60 forms a fluid-impervious seal 96 with the mouth 105 of the bottle 100, so that the beverage in the bottle 100 cannot leave the bottle 100 and enter the interior 15. Further, the cuff 54 of the cap 12 fully seated against the lip 32 of the container and forms a fluid-impervious seal 97 with the container 11. This seal 97 prevents any moisture in the interior 15 from exiting the interior 15 and also prevents any fluids outside of the enclosure 10 from entering the interior 15. The seal 96 is considered an inner seal, and the seal 97 is considered an outer seal spaced apart from the inner seal, so that the enclosure 10 has a unique double-seal construction which is formed when the cap 12 is in the seated condition on the container 11.

Alternately, the bottle 100 and container 11 can be sealed by the cap 12'. FIG. 4B shows the cap 12' fully seated on and sealing the open mouth 105 of the bottle 100. FIG. 4B does not show the container 11, as one having ordinary skill in the art will understand how the cap 12' seats on the container 11, given the above description of the cap 12 and the container 11, and given the below description. To apply the cap 12' to the container 11 with the bottle 100 held in the container 11, the cap 12' is free of the container 11 and is aligned with the neck 30 and finish 31 of the container 11 in a free condition of the cap 12'. The threads 53 on the cap 12' are directed downwardly toward the threads 42 on the neck 30 of the container 11. The cap 12' is then rotated onto the neck 30, threadably engaging the threads 53 on the cap 12' with the threads 42 formed in the neck 30 of the container 11 to move the cap 12' into an applied condition on the container 11. As the cap 12' is threaded onto the container 11, the cap 12' is applied to the container 11, and the bottom 73 of the stopper 70 moves into the mouth 105 of the bottle 100.

The bottom 73 of the stopper 70 has a diameter G' which is less than the diameter M of the mouth 105, so that the mouth 105 begins to receive the stopper 70. As the cap 12' is further threaded onto the container 11, the stopper 70 advances further into bottle 100, filling a greater portion of the diameter M of the mouth 105. In this applied condition of the cap 12', the cap 12' only yet forms a fluid-permeable seal with the container 11. As the cap 12' is still further threaded onto the container 11, however, the stopper 70 fills the entire open mouth 105 of the bottle 100, and begins to be compressed and constricted radially by the mouth 105. The cap 12' continues to be advanced until the top 106 of the bottle 100 binds on the body 71 of the stopper 70, at which point the cuff 54 of the cap 12' also fully seats against the lip 32 of the upper portion 13 of the container 11. The diameter of the body 71 of the stopper 70 encircled by the mouth 105 is just less than the diameter M of the mouth 105, defining a seated condition of the cap 12 on the container 11. In this seated condition, the stopper 70 forms a fluid-impervious seal 95' with the mouth 105 of the bottle 100, so that the beverage in the bottle 100 cannot leave the bottle 100 and enter the interior 15. This seal 96 is considered an inner seal. Further, the cuff 54 of the cap 12' fully seated against the lip 32 of the container and forms a fluid-impervious seal with the container 11. This seal is considered an outer seal, and it prevents any moisture in the interior 15 from exiting the interior 15 and also prevents any fluids outside of the enclosure 10 from entering the interior 15. The enclosure 10 has this unique double-seal construction which is formed when the cap 12' is in the seated condition on the container 11.

Alternately, the bottle 100 and container 11 can be sealed by the cap 12". FIG. 4C shows the cap 12" fully seated on and sealing the open mouth 105 of the bottle 100. FIG. 4C does not show the container 11, as one having ordinary skill in the art will understand how the cap 12" seats on the container 11, given the above description of the cap 12 and the container 11, and given the below description. To apply the cap 12' to the container 11 with the bottle 100 held in the container 11, the cap 12' is free of the container 11 and is aligned with the neck 30 and finish 31 of the container 11 in a free condition of the cap 12". The threads 53 on the cap 12" are directed downwardly toward the threads 42 on the neck 30 of the container 11. The cap 12" is then rotated onto the neck 30, threadably engaging the threads 53 on the cap 12" with the threads 42 formed in the neck 30 of the container 11 to move the cap 12" into an applied condition on the container 11. As the cap 12" is threaded onto the container 11, the cap 12" is applied to the container 11, the mouth 105 of the bottle 100 contacts the lower surface 83 of the pad 81 of the stopper 80. As the cap 12" is still further threaded onto the container 11, the mouth 105 of the bottle 100 advances into the pad 81, deflecting the lower surface 83 and compressing the middle layer 84 toward the upper surface 82. The pad 81 continues to be compressed by the mouth 105 until the cap 12" is fully threaded onto the container 11, seating the cuff 54 of the cap 12" against the lip 32 of the container 11 in a seated condition of the cap 12". In the seated condition of the cap 12", a fluid-impervious seal 96" is formed between the pad 81 and the mouth 105 of the bottle 100, which seal 96" is considered an inner seal preventing the loss of the beverage contained in the bottle 100 into the interior 15 of the enclosure 10. Further, in the seated condition of the cap 12", the cuff 54 of the cap 12" forms a fluid-impervious seal with the container 11. This seal is considered an outer seal, and it prevents any moisture in the interior 15 from exiting the interior 15 and also prevents any fluids outside of the enclosure 10 from entering the interior 15. The enclosure 10 has this unique double-seal construction which is formed when the cap 12" is in the seated condition on the container 11.

Once the enclosure 10 is sealed with the cap 12, 12', or 12" (discussion herein with respect to the cap 12), the bottle 100 can be carried, tilted, or tipped without spilling the beverage within the bottle 100 inside the enclosure 10. The cap 12 can be removed to allow a person to drink from the bottle 100, simply by unthreading the cap 12 from the container 11 and moving the cap 12 into the free condition thereof, exposing the mouth 105 of the bottle 100 which is spaced above the lip 32 of the upper portion 13 of the container 11 by a distance T. The mouth 105 is also spaced apart from the lip 32 of the upper portion 13 of the container 11 by an annular gap 98 encircling the mouth 105. This annular volume 64 is a gap between the mouth 105 of the bottle 100 and the lip 32 of the enclosure 10 which allows a person to place his or her lips on the bottle itself. This can prevent spilling of the beverage into the interior 15 or simply out of the bottle 100 altogether, because a seal is formed between the mouth 105 of the bottle 100 and the person's lips. Alternatively, the person may place his or her lips around the lip 32 of the enclosure 10 and drink from the bottle 100.

The present disclosure is described above with reference to several embodiments, among them a preferred embodiment. However, those skill having ordinary skill in the art will appreciate that changes and modifications may be made in the described embodiments without departing from the nature and scope of the present disclosure. Various further changes and modifications to the embodiment herein chosen for purposes of illustration will readily occur to one having ordinary skill in the art. To the extent that such modifications and variations do not depart from the principle of the disclosure, they are intended to be included within the scope thereof.

What is claimed is:

1. A bottle enclosure for removably enclosing a bottle, the enclosure comprising:

a base including a cylindrical base sidewall that extends from a base bottom wall and an open top, the base including at least one thread disposed adjacent the open top, wherein a portion of the base bottom wall comprises a planar bottom surface;

a body section comprising a cylindrical body wall that includes an interior threading adjacent a bottom opening, the body section further comprising a tapered shoulder section that is positioned between the cylindrical body wall and a neck section, the neck section extending upward from the shoulder section, the neck section comprising a cylindrical neck wall comprising a neck thread and defining a neck opening, wherein an internal cavity is located between the neck opening and the bottom opening, the shoulder section being disposed between the neck section and the cylindrical body wall, the body section being configured to threadably and removably engage the base sidewall of the base; and a removable cap comprising a cap sidewall surrounding a cap cavity, the cap cavity extending between a top wall and a cap opening, the cap sidewall being configured to threadably and removably engage the neck section and including a knob and an extension, the knob including a contact surface configured to be gripped or rotated, wherein a sealing structure is disposed underneath an underside of the top wall of the cap for sealing to a mouth of the bottle while the bottle is housed within the bottle enclosure.

2. The bottle enclosure of claim 1, wherein the cylindrical body wall comprises plastic.

3. The bottle enclosure of claim 1, wherein an aperture extends through the knob.

4. The bottle enclosure of claim 1, wherein the neck opening defines a first diameter that is smaller than both a second diameter of the bottom opening of the body section and a third diameter of the open top of the base.

5. The bottle enclosure of claim 1, wherein cap threading along the cap extends from the cap sidewall.

6. The bottle enclosure of claim 5, wherein the cap threading extends outwardly from the cap sidewall.

7. The bottle enclosure of claim 1, wherein the base, the shoulder section, the neck section, and the cap are configured to surround and enclose the bottle.

8. The bottle enclosure of claim 1, wherein the shoulder section tapers inwardly in diameter.

9. A bottle enclosure for removably enclosing a bottle, the enclosure comprising:

a base section having a bottom wall from which a base sidewall extends, the base sidewall defining a base opening that is disposed opposite the bottom wall;

a body section defining a body sidewall and a body opening, wherein the body section is configured to threadably and removably engage the base sidewall;

a shoulder section that is disposed adjacent the body section and defined by a tapered shoulder sidewall;

a neck section including a neck sidewall that defines a neck opening, the neck section being disposed adjacent the shoulder section;

an internal cavity that is disposed between the body opening and the neck opening; and a cap including a top wall that is integral with a cap sidewall, the cap sidewall defining a cap opening that is disposed opposite the top wall, the cap being configured to threadably and removably engage the neck section, wherein the base sidewall and the body sidewall are cylindrical;

wherein the base section, the body section, the shoulder section, the neck section, and the cap are configured to surround and enclose a bottle;

wherein the body sidewall comprises plastic; and wherein a sealing structure is coupled to an underside of the top wall of the cap for sealing to a mouth of the bottle while the bottle is housed within the bottle enclosure.

10. The bottle enclosure of claim 9, wherein the neck opening defines a first diameter that is smaller than both a second diameter of the bottom opening of the body section and a third diameter of the base opening.

11. The bottle enclosure of claim 9, wherein an entirety of the body sidewall is cylindrical.

12. The bottle enclosure of claim 9, wherein the neck section further includes at least one thread extending outwardly from the neck sidewall.

13. The bottle enclosure of claim 9, wherein the cap includes a knob that is configured to be gripped and rotated.

14. The bottle enclosure of claim 13, wherein the knob includes a knob aperture that extends through the knob.

15. The bottle enclosure of claim 9, wherein the sealing structure is fixedly coupled to the top wall of the cap.

16. A bottle enclosure for removably enclosing a bottle, the enclosure comprising:

a base section including a bottom wall from which a base sidewall extends, the base sidewall defining a base opening disposed opposite the bottom wall;

a body section including a body sidewall and a body opening, the body section being configured to threadably and removably engage the base sidewall;

a shoulder section that is disposed adjacent the body section and includes a tapered shoulder sidewall;

a neck section including a neck sidewall and a neck opening, wherein the neck section is integral with the shoulder section, the shoulder section being disposed above the body section; and a cap including a top wall that is integral with a cap sidewall, the cap sidewall defining a cap opening disposed opposite the top wall, the cap being configured to threadably and removably engage with the neck section, wherein the base sidewall and the body sidewall are cylindrical;

wherein the base section, the body section, the shoulder section, the neck section, and the cap are configured to surround and enclose an entire bottle; and wherein the cap surrounds a sealing structure that is configured to seal to an open mouth of a bottle.

17. The enclosure of claim 16, wherein the neck opening has a first diameter that is smaller than a second diameter of the body opening.

18. The enclosure of claim 16, wherein the base sidewall comprises metal and the body sidewall comprises plastic.

19. The enclosure of claim 16, wherein the cap sidewall includes at least one thread along a surface of the cap sidewall.

20. The enclosure of claim 16, wherein the sealing structure is a plug.

21. The enclosure of claim 16, wherein the enclosure is configured to insulate the bottle.

22. A bottle enclosure for removably enclosing a bottle, the enclosure comprising:

a base section including a bottom wall from which a base sidewall extends, the base sidewall defining a base opening disposed opposite the bottom wall;

a body section including a body sidewall and a body opening, the body section being configured to threadably and removably engage the base sidewall;

a shoulder section that is disposed adjacent the body section and includes a tapered shoulder sidewall;

a neck section including a neck sidewall and a neck opening, wherein the neck section is integral with the shoulder section, the shoulder section being disposed above the body section;

a cap including a top wall that is integral with a cap sidewall, the cap sidewall defining a cap opening disposed opposite the top wall, the cap being configured to threadably and removably engage with the neck section; and a sealing structure, wherein the base sidewall and the body sidewall are cylindrical, wherein the base section, the body section, the shoulder section, the neck section, and the cap are configured to surround and enclose an entire bottle, and wherein the sealing structure is configured to seal to an open mouth of the bottle.

23. The bottle enclosure of claim 22, wherein the sealing structure is positioned within the cap.

24. The bottle enclosure of claim 22, wherein the sealing structure is compressible.

25. The bottle enclosure of claim 22, wherein the sealing structure comprises a truncated conical frustum shape.

26. The bottle enclosure of claim 22, wherein the cap includes a knob that is configured to be gripped and rotated.

27. The bottle enclosure of claim 25, wherein the knob includes a knob aperture that extends through the knob.

28. The bottle enclosure of claim 22, wherein cap threading along the cap extends from the cap sidewall.

* * * * *